US007635249B2

(12) United States Patent
Guidroz

(10) Patent No.: US 7,635,249 B2
(45) Date of Patent: Dec. 22, 2009

(54) PIPE PICK-UP AND LAYDOWN APPARATUS

(76) Inventor: Perry J. Guidroz, 1060 Julie St., Breaux Bridge, LA (US) 70517

( * ) Notice: Subject to any disclaimer, the term of this patent is extended or adjusted under 35 U.S.C. 154(b) by 55 days.

(21) Appl. No.: 11/089,706

(22) Filed: Mar. 24, 2005

(65) Prior Publication Data

US 2006/0045654 A1 Mar. 2, 2006

Related U.S. Application Data

(60) Provisional application No. 60/602,970, filed on Aug. 18, 2004.

(51) Int. Cl.
*B65G 1/133* (2006.01)
*E21B 19/00* (2006.01)

(52) U.S. Cl. ..... 414/746.1; 414/22.52; 414/22.61; 414/22.54; 414/589

(58) Field of Classification Search ..... 254/3 R, 254/10 R, 89 H, 3 C; 414/22.51–22.62, 22.65, 414/22.68, 22.69, 22.71, 589, 501, 746.1, 414/528, 590; 187/244, 269, 211, 215; 108/145; 182/69.5; 175/52
See application file for complete search history.

(56) References Cited

U.S. PATENT DOCUMENTS 2,535,546 A 12/1950 Pitts
2,576,907 A 11/1951 Wallace
2,576,908 A * 11/1951 Wallace ..... 187/211
2,617,547 A 11/1952 Pridy
2,643,006 A 6/1953 King
2,656,052 A 10/1953 Tucker
2,922,533 A 1/1960 LaBarge, Jr.
3,053,401 A 9/1962 Jinkins, Jr.
3,254,776 A 6/1966 Brown
3,259,255 A 7/1966 Cresci
3,559,821 A 2/1971 James
3,706,347 A 12/1972 Brown
3,792,783 A 2/1974 Brown
3,810,553 A 5/1974 Crocker et al
4,054,210 A 10/1977 Crocker
4,067,453 A * 1/1978 Moller ..... 414/22.61
4,140,227 A * 2/1979 Beck ..... 414/22.52
4,235,566 A 11/1980 Beeman et al.
4,347,028 A 8/1982 Dugan (Continued)

OTHER PUBLICATIONS

U.S. Appl. No. 11/801,877, Perry J. Guidroz.

*Primary Examiner*—Gregory W Adams

(57) ABSTRACT

A self-contained, freestanding, modular, portable pipe pick-up and laydown apparatus. The apparatus includes a movable carriage and carriage rail supported on base frame. The base frame includes means for moving the carriage along the length of base frame. The apparatus also includes a pipe trough supported on first and second telescoping pipe trough lifting assemblies pivotally mounted on the carriage. The pipe trough is semicircular in configuration which serves to cradle and manipulate a joint of pipe. Jacks are used to lift and tilt upward the telescoping pipe trough lifting assembles to raise the pipe trough and any supported pipe. The pipe trough may be leveled and otherwise manipulated by extension and retraction of the trough lifting assemblies. A hydraulic lift and detachable hinges are used to pivot the pipe trough on its edges as desired. The invention also provides a movable pipe jack and reversible pipe guides to facilitate the loading and unloading of pipe to and from the pipe trough.

6 Claims, 11 Drawing Sheets

U.S. PATENT DOCUMENTS 4,371,302 A 2/1983 Frias et al.
4,379,676 A 4/1983 Frias
4,382,738 A 5/1983 Frias
4,386,883 A 6/1983 Hogan
4,403,898 A 9/1983 Thompson
4,426,182 A 1/1984 Frias
4,470,740 A 9/1984 Frias
4,494,899 A 1/1985 Hoang
4,544,322 A * 10/1985 Booker ..... 414/589
4,552,498 A 11/1985 Dysarz
4,684,314 A * 8/1987 Luth ..... 414/746.1
5,122,023 A 6/1992 Mochizuki
5,451,129 A 9/1995 Boyadjieff
6,079,925 A 6/2000 Morgan et al.
7,021,880 B2 4/2006 Morelli

* cited by examiner

PIPE PICK-UP AND LAYDOWN APPARATUS

This application claims priority to U.S. Provisional Application Ser. No. 60/602,970 filed Aug. 18, 2004 by Perry J. Guidroz, the entire contents of which are hereby incorporated by reference.

FIELD OF INVENTION

The present invention relates to a device for manipulating a joint of pipe. More specifically, this invention relates to a modular, self-contained, freestanding, portable pipe joint manipulating apparatus.

BACKGROUND OF INVENTION

Oil and gas drilling and production operations often require the use of long strings of pipe. Such pipe strings are typically comprised of individual segments of pipe called pipe joints that are secured together. During such operations, individual pipe joints may be added or removed from a pipe string. These individual pipe joints are typically at least thirty feet in length and are extremely heavy. Consequently, some sort of pipe lifting apparatus is typically required as an aid for lifting, stacking or otherwise manipulating these pipe joints.

The present invention provides a new design for a pipe manipulating apparatus. The proposed design provides a lifting apparatus in a self-contained, freestanding modular unit that is fully portable and easily operated. The mechanism of the present invention eliminates the complicated boom and cable systems as well as the cumbersome scissor jack lifting systems that have been typically employed in such lifting devices. The controls for Applicant's lifting device may be positioned at a point remote from the lift in order to place the device operator in a more secure environment.

SUMMARY OF INVENTION

The invention is comprised of a longitudinally extending base frame assembly having a system of base rails or tracks, a movable carriage having a carriage frame and roller assembly that supports the movable carriage on the frame base rails, and a pipe lifting structure that is mounted to this movable carriage. The carriage, and consequently the pipe lifting structure, is configured so that it may be moved as desired along the length of the base frame by means of the carriage rollers and base rail system to facilitate a desired lifting sequence.

The pipe lifting structure is comprised of a semicircular pipe support trough that is supported by first and second longitudinally spaced apart hydraulically driven telescopically extendable lifting arm assembles. The base end of each telescopically extendable lifting arm assembly is pivotally mounted to the carriage. The trough end of each lifting arm assembly is pivotally mounted to a lifting structure stabilizer frame that extends longitudinally between each lifting arm assembly.

Semicircular cradles or trough saddles are positioned along the lifting structure stabilizer frame for supporting the pipe support trough. The pipe lifting trough is pivotally mounted at a point along its longitudinally axis to the ram of a trough lifting jack mounted to the lifting structure frame. The pipe support trough is further secured at its edges at the semicircular ends of each of the trough saddles of the lifting structure stabilizer frame by means of trough hinge assemblies having removable hinge pins. Selective removal and/or placement of the hinge pins of the trough hinge assemblies will allow the pipe support trough to be tilted to either side of the pipe lifting structure as may be desired by extension of the ram of the trough lifting jack.

An extendable and retractable ram mechanism is positioned between the first and second lifting arm assemblies and pivotally mounted to the carriage and to the first lifting arm assembly. In this manner an extension and retraction of the ram will raise, and lower as desired, the first lifting arm assembly, and the connected pipe trough, as it pivots at its carriage mounting end.

Because the second lifting arm assembly is connected to the first lifting arm by means of the pivotally connected lifting structure stabilizer frame, the second lifting arm assembly will also pivot at the carriage, follow the movements of the first lifting arm assembly and rise and fall as it supports the connected trough assembly. The pipe trough is tilted and lifted up in a swinging motion as the lifting arms are raised and lowed by extension and retraction of the carriage and lifting arm hydraulic ram assembly. The pipe trough may be further lifted, tilted or leveled by independent extension or retraction of the telescopically extendable first and second lifting arm assemblies.

It is thought that hydraulic cylinder means will be utilized to extend the lifting arm and ram assemblies described herein though other means such a mechanically or electrically driven screw or ratchet mechanism may be utilized. It is also thought that an operator located at a centralized control point would control these mechanisms. Such a centralized control point would keep the operator away from the lifting areas and thus reduce the risk of injury to the operator. Electrical, hydraulic, pneumatic, or mechanical control systems, or combinations of these systems, may be employed to operate the lifting arm and ram assemblies.

Another feature of Applicant's invention is its pipe loading mechanism used to move pipe from a pipe rack to the pipe trough that employs hydraulically actuated lifting jack arms and a reversible pipe guide. The pipe guides may be reversed to change direction of the guide surface bumper so that pipe joints may be guided onto and then off of the pipe trough with the aid of the jack arms. The jack arms may be adjusted to different positions on the base rail to facilitate such lifts.

Another feature of Applicant's invention is the mechanism employed to roll the pipe joints out of the pipe trough. The mechanism employs the use of the aforementioned pipe trough/pipe saddle hinge and removable hinge pin mechanism. Selected removal and placement of the saddle and pipe trough hinge pins in association with the centrally positioned trough lifting jack described above will allow the pipe support trough to be tilted to either side of the pipe lifting structure as may be desired.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DRAWINGS—REFERENCE NUMERALS

| | | | |
|---|---|---|---|
| 10 | Apparatus | 12 | Base Frame |
| 14 | Base Support Rails | 14A | Rail Stops |
| 16 | Carriage | | |
| 18 | Support Roller Assembly | 20 | Pipe Lifting Structure |
| 21 | Lower Lifting Arm Columns | 22 | Pipe Support Trough |
| 22A | Trough Lift Bearing | 23 | Upper Lifting Arm columns |
| 24 | Telescoping Lifting Arm Assembly | 25 | Lifting Arm Extension Assembly |
| 25A | Lifting Arm Extension Jack | 26 | Telescoping Lifting Arm Assembly |
| 28 | Lifting Arm Base Bearing | 30 | Stabilizer Frame |
| 32 | Stabilizer Frame Bearing | 34 | Trough Saddles |
| 36 | Trough Lift | 36A | Trough Lift Ram |
| 38 | Trough Hinge Assembly | 38A | Saddle Hinge Links |
| 38B | Trough Hinge Links | 38C | Removable Trough Hinge Pins |
| 40 | Lifting Arm Lift Assembly | 40A | Lifting Arm Lift Ram |
| 42 | Lifting Arm Lift Ram Bearing | 44 | Pipe Loading Mechanism |
| 46 | Pipe Lifting Jack | 48 | Reversible Pipe Guide |
| 52 | Lifting Jack Strut | 54 | Bearings |
| 56 | Extendable Jack | 58 | Extendable Jack Ram |
| 60 | Pipe Lift | 62 | Upper Pipe Lift Support Bracket |
| 63 | Male Support Strut | 64 | Pipe Lift Lower Leg |
| 65 | Support Strut Socket | 66 | Bracket Bearing |
| 68 | Bracket Bearing | 70 | Lower Pipe Guide Frame |
| 72 | Pipe Guide Socket Column | 74 | Upper Pipe Guide Frame |
| 76 | Upper Pipe Guide Frame Legs | 78 | Pipe Guide Bar |

DETAILED DESCRIPTION OF THE INVENTION

Figure 1:
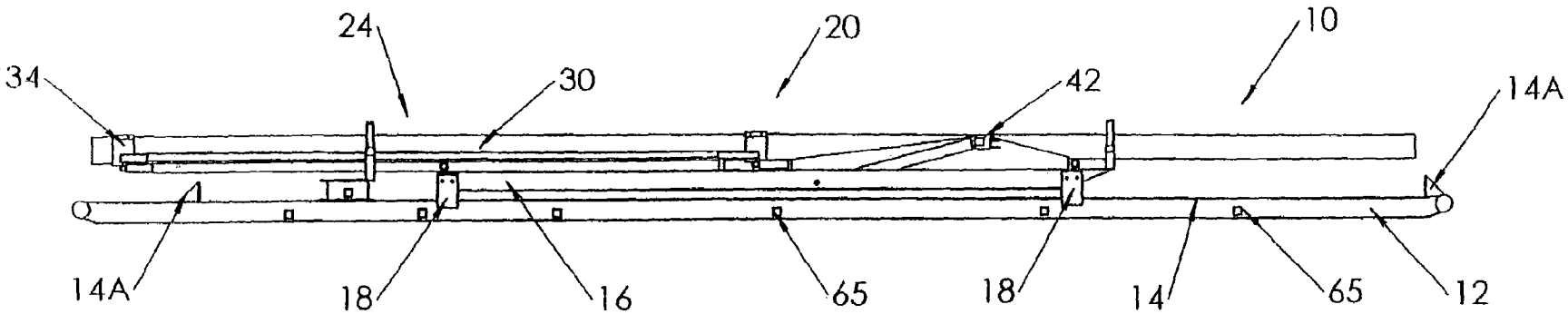
FIG. 1 is a side view of the Applicant's claimed invention with the lifting trough in a lowered position.

Referring now to the drawings and more particularly to FIG. 1, there is shown a side view of the pipe pick-up and laydown apparatus (10) of Applicant's invention. The apparatus (10) is comprised of a base frame (12) that supports a system of support rails (14). A movable carriage (16) is positioned on the support rails (14) by means of carriage support roller assemblies (18).

The carriage (16) may be moved along the system of support rails (14) by means of the roller assemblies (18) and a carriage propulsion mechanism (not shown) to place the carriage (16) in a desired position along the base frame (12) to facilitate a desired lifting position or sequence. Rail stops (14A) maintain the carriage (16) on the rail system (14).

It is thought that the carriage propulsion mechanism will employ the use of extendable and retractable hydraulic rams as the means to move the carriage (16) along the support rails (14). However, the carriage propulsion mechanism could also employ electrical, hydraulic, pneumatic or mechanical means, such as a motor driven pulley and cable system or a motor driven system of threaded rods and gears.

A pipe lifting structure assembly (20) is shown mounted to the movable carriage (16). The pipe lifting structure assembly (20) is comprised of a semicircular pipe support trough (22) that is pivotally supported on a first telescopically extendable lifting arm assembly (24) and a second telescopically extendable lifting arm assembly (26) spaced apart from each other along the longitudinal axis of the carriage (16). Each telescopically extendable lifting arm assembly (24, 26) is pivotally mounted to the carriage (16) by means of a lifting arm base hinged bearing (28).

A lifting structure stabilizer frame (30) is pivotally attached to each telescopically extendable lifting arm assembly (24, 26) at the ends distal from the carriage (16) by means of stabilizer frame bearings (32). The lifting structure stabilizer frame (30) extends longitudinally along the trough (22). The lifting structure stabilizer frame (30) is provided with semicircular cradles or trough saddles (34) to support the trough (22) on the lifting structure stabilizer frame (30). A trough lift (36) is mounted to the lifting structure stabilizer frame (30). The trough lift (36) has an extendable ram (36A) pivotally attached to a trough lift bearing (22A) located below the trough (22) at a point on its longitudinal centerline axis.

Trough hinge assemblies (38) further secure the trough (22) to the stabilizer frame (30). These trough hinge assemblies (38) are comprised of saddle links (38A) mounted at the semicircular ends of each of the trough saddles (34), trough links (38B) mounted on the perimeter of the trough (22) and removable trough hinge pins (38C). Selective removal and/or placement of the hinge pins (38C) will allow the pipe support trough (22) to be tilted on the trough bearing assemblies, as it pivots on trough lift bearing (22A), to either side of the pipe lifting structure (20) as may be desired by the extension of the ram (36A) of the trough lift (36). In this manner pipe lifted in the trough (22) can be rolled from the trough (22) to either side of the lifting assembly (20) as may be required by a user.

As shown in the Figures, lifting arm lift assemblies (40) having an extendable and retractable rams (40A) are pivotally mounted to the carriage (16) positioned between the first (24) and second (26) lifting arm assemblies. The rams (40A) of each ram assembly are pivotally mounted to a bearing (42) on the first lifting arm assembly (24) in a manner such that when the rams (40A) are extended and retraced, the lifting arm assembly (24) will pivot on its lifting arm base hinged bearing (28). In this manner, extension and retraction of the rams (40A) will raise, and lower as desired, the first lifting arm assembly (24), and the connected pipe trough (22) will be lifted, as the lifting arm assembly pivots at the carriage (16) on the lifting arm base bearing (28).

Because the second lifting arm assembly (26) is connected to the first lifting arm assembly (24) by means of the pivotally connected lifting structure stabilizer frame (30), the second lifting arm assembly (26) will also pivot at the carriage (16) on its lifting arm bearing (28). Thus, the second lifting arm assembly (26) will follow the movements of the first lifting arm assembly (24) as imparted by the lift assemblies (40) and rise and fall as it supports the connected trough assembly (22). The pipe trough (22) will move in a swinging motion as the lifting arm assembly (26) is raised and lowed by extension and retraction of the ram (40A) of the ram assembly (40). The pipe trough (22) may be further lifted, tilted or leveled by independent extension or retraction of the telescopically extendable first and second lifting arm assemblies (24, 26).

The lifting arm assemblies (24) and (26) may be moved from a horizontal position with respect to base frame (12) and carriage (16) to a vertical, perpendicular position with respect to the base frame (12) and carriage (16) by extension and retraction of rams (40A).

Figure 10:
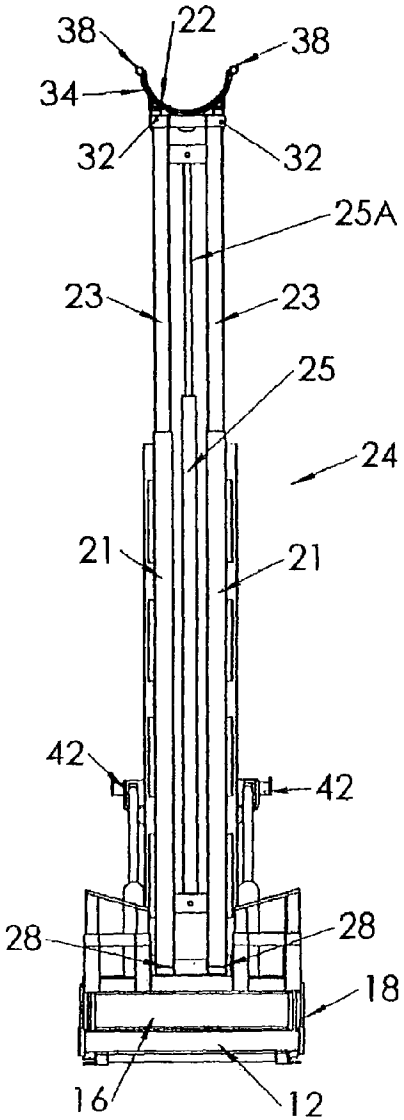
FIG. 10 is an end view of the first lifting arm assembly.

FIG. 10 shows an end view of the configuration of the telescoping lifting assembly (24). The assembly (24) is comprised of lower tubular columns (21) mounted to the lifting arm base hinge bearings (28). Corresponding retractable upper tubular columns (23) are inserted into the lower columns (21). The distal ends of the upper tubular columns (23) are mounted to the semicircular pipe support trough (22) by means of the lifting structure stabilizer bearings (32).

A central extendable lifting arm extension assembly (25) having an extendable jack (25A) is mounted to the hinge bearing (28) between the columns (21). The jack (25A) is also mounted to the lifting structure bearing (32). Extension or retraction of the jack (25A) will serve to extend the columns (23), which serve as a guide and support for the extension assembly (25). Retraction and extension of the jack (25A) will raise and lower the pipe support trough (22).

Lifting arm assembly (26) is similar to lifting arm assembly (24) and has a similar arrangement of columns (21) and (23) and bearings (28) and (32), along with a lifting arm extension assembly (25), to allow the attached pipe support trough (22) to be raised and lowered in the manner as described above. It is thought that hydraulic cylinder means will be utilized in the lift assembly (40) and in the extension assembly (25) to extend and retract the telescoping lifting arm described herein though other means such a mechanically or electrically driven screw or ratchet mechanism may be utilized.

Figure 8:
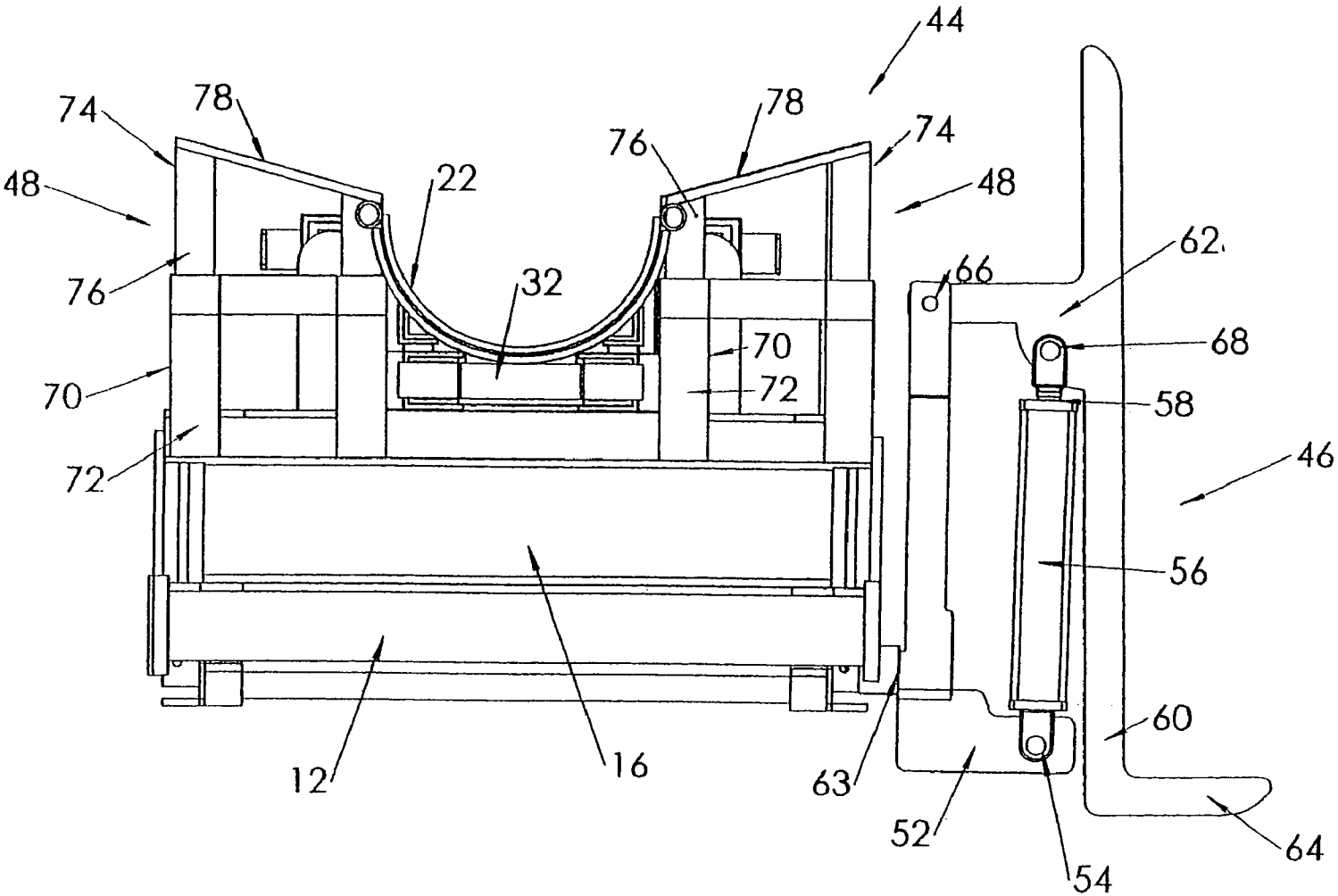
FIG. 8 is an end view of Applicant's claimed invention with the pipe guide in place and with pipe jack on the frame in a lowered position.
Figure 9:
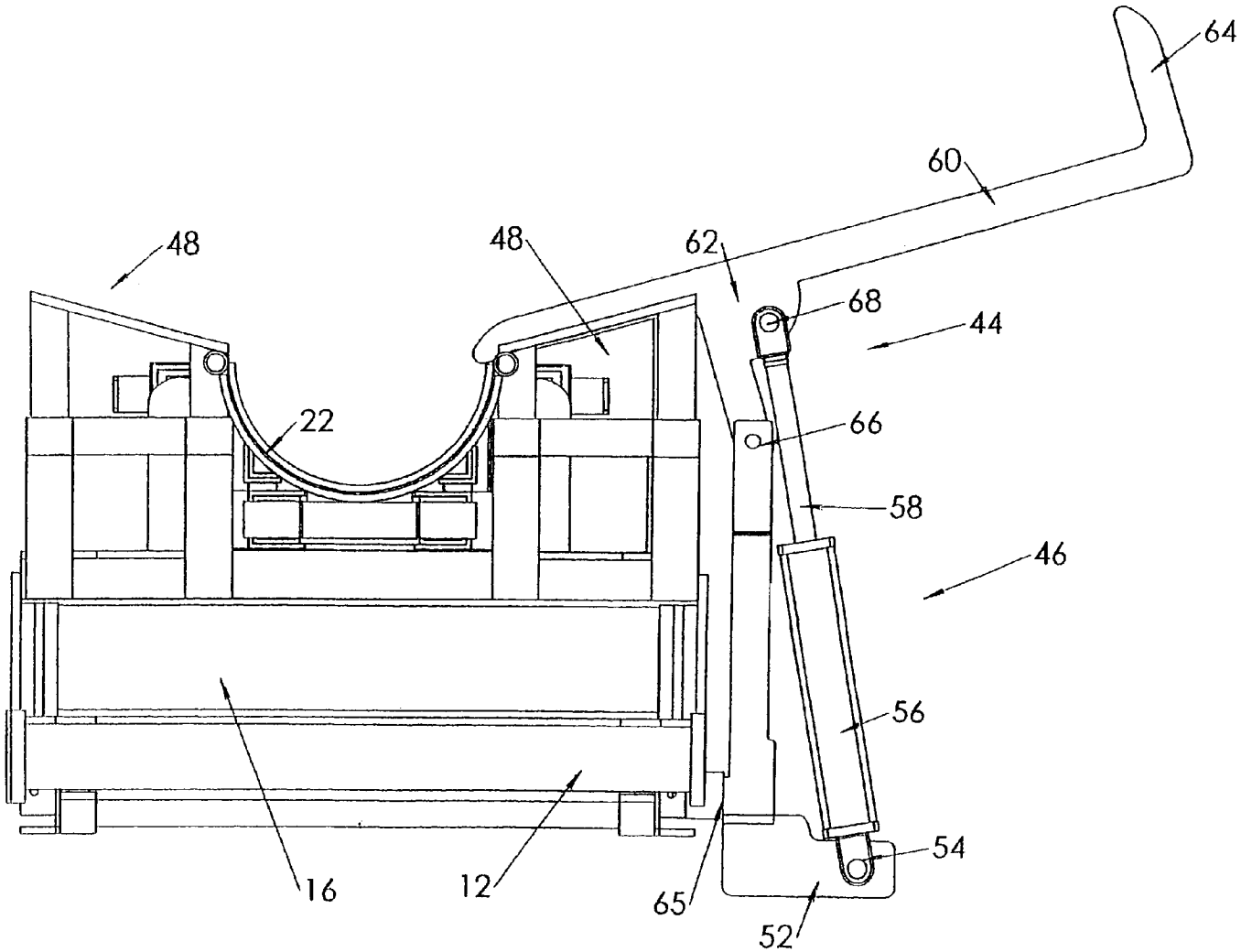
FIG. 9 is an end view of Applicant's claimed invention with the pipe guide in place and with pipe jack on the frame in a lifted position.

FIGS. 8 and 9 show the pipe loading mechanism (44). This mechanism employs a pipe lifting jack (46) and a reversible pipe guide (48). The pipe lifting jack (46) has an L-shaped strut (52) to which is pivotally mounted by means of bearings (54) an extendable jack (56) having a ram (58). An L-shaped pipe lift (60), having an upper support bracket (62) and an opposing lower leg (64), is pivotally mounted at the support bracket (62) of the L-shaped lift (60) on the strut (52) by bearing means (66). The ram (58) of the jack (56) is pivotally mounted by bearing means (68) to the support bracket (62) of the L-shaped pipe lift (60).

Extension and retraction of the ram (58) will raise the lower leg (64) of the pipe lift (60) as the leg pivots on the bracket bearings (66) and (68). Continued extension of the ram (58) will tilt the L-shaped pipe lift (60) into the guide plane of the pipe guide bar (78) of the pipe guide (48). In this manner, a pipe joint may be lifted by the lower leg (64) of the pipe lift (60) and retained on the leg (64) as the pipe lift (60) is moved through its pivoting arc. Further extension of the ram (58) will allow a retained pipe to roll of the pipe lift (60) and onto the pipe guide bar (78) of the pipe guide (48) and then guided into the pipe trough (22).

The pipe lifting jack (46) has a male support strut (63) adapted to fit into a female support strut socket (65) positioned on the base frame (12) of pick up and laydown apparatus (10). A number of support sockets (65) may be placed on the frame (12) in desired locations to allow the pipe lifting jack (46) to be positioned on the frame (12) as desired or to accommodate the use of multiple pipe lifting jacks (46).

The pipe guide (48) is comprised of a lower frame (70) having socket columns (72) mounted on the carriage (16). A corresponding removable upper frame (74) having legs (76) fits into the corresponding socket columns (72). The upper frame (74) is configured to support a diagonally orientated guide bar (78) on its legs (76). Reversing the orientation of the upper frame (74) and reinserting it into the socket columns (72) will change the orientation of the guide bar (78). This changes the direction of the guide bar (78) to slope to or from the pipe trough (22) so that pipe joints may be guided onto and then off of the pipe trough with the aid of the pipe lift (60).

Figure 6:
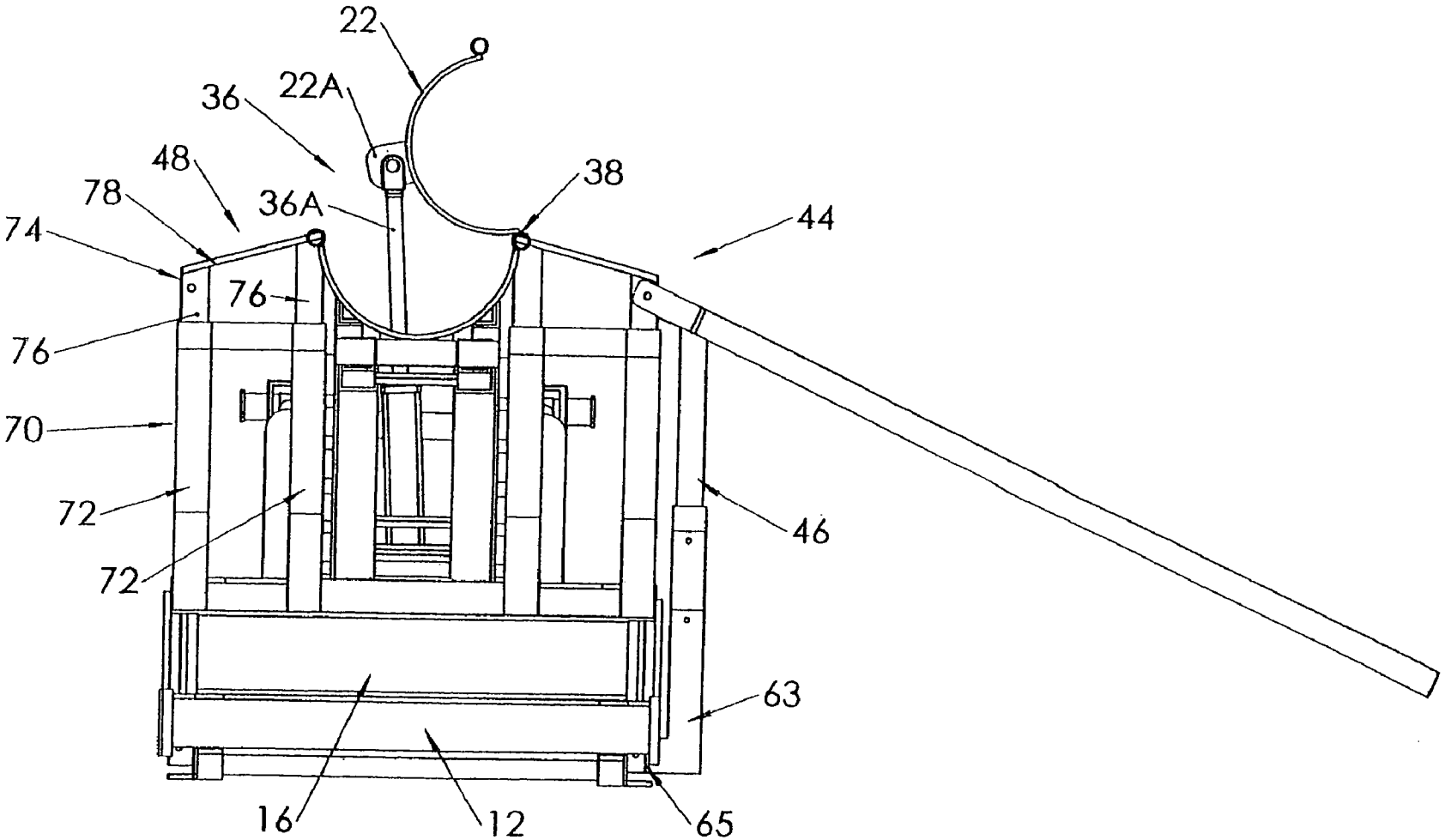
FIG. 6 is an end view of Applicant's claimed invention, showing the pivoting trough, pipe guide and pipe lifting jack.
Figure 7:
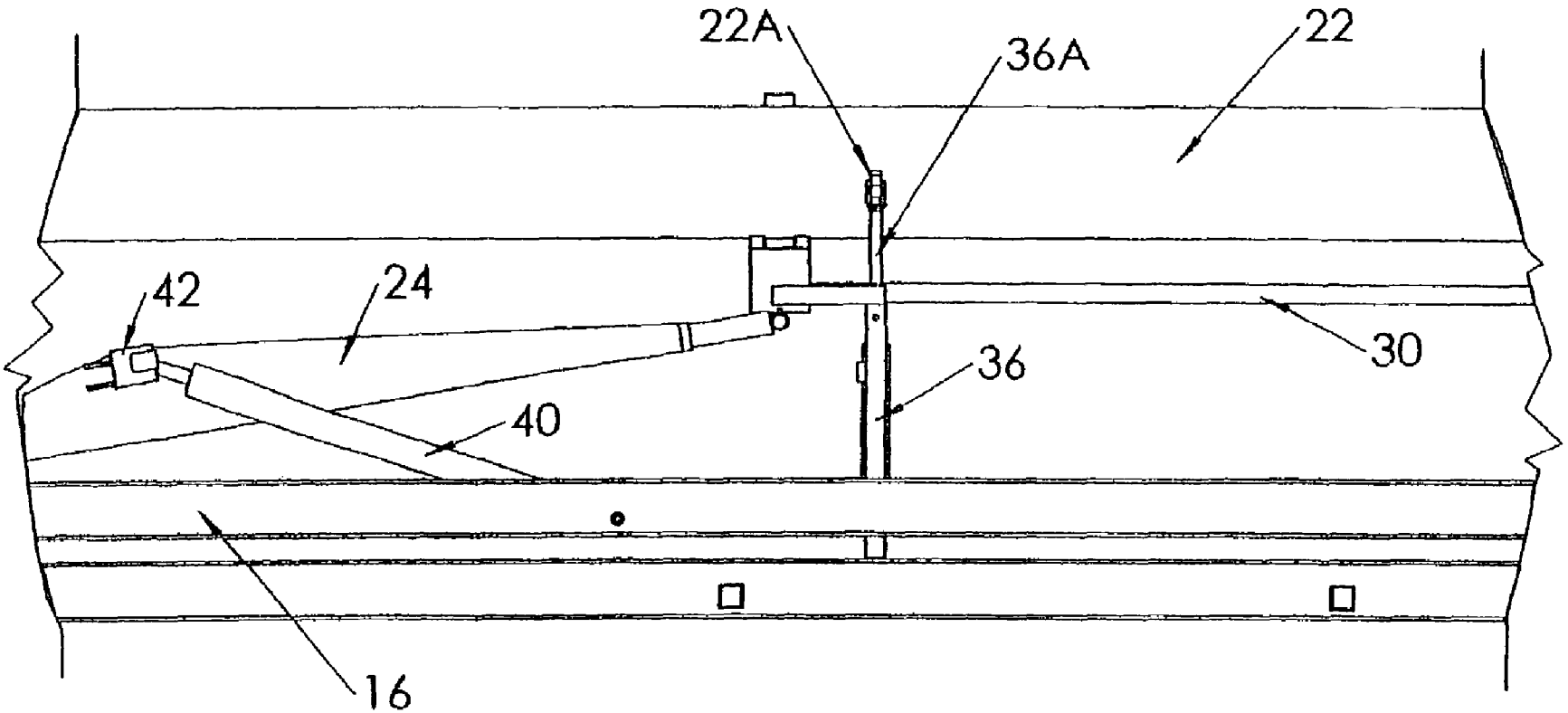
FIG. 7 is a partial side view of Applicant's claimed invention showing the pivoting trough and pipe lifting jack.
Figure 11:
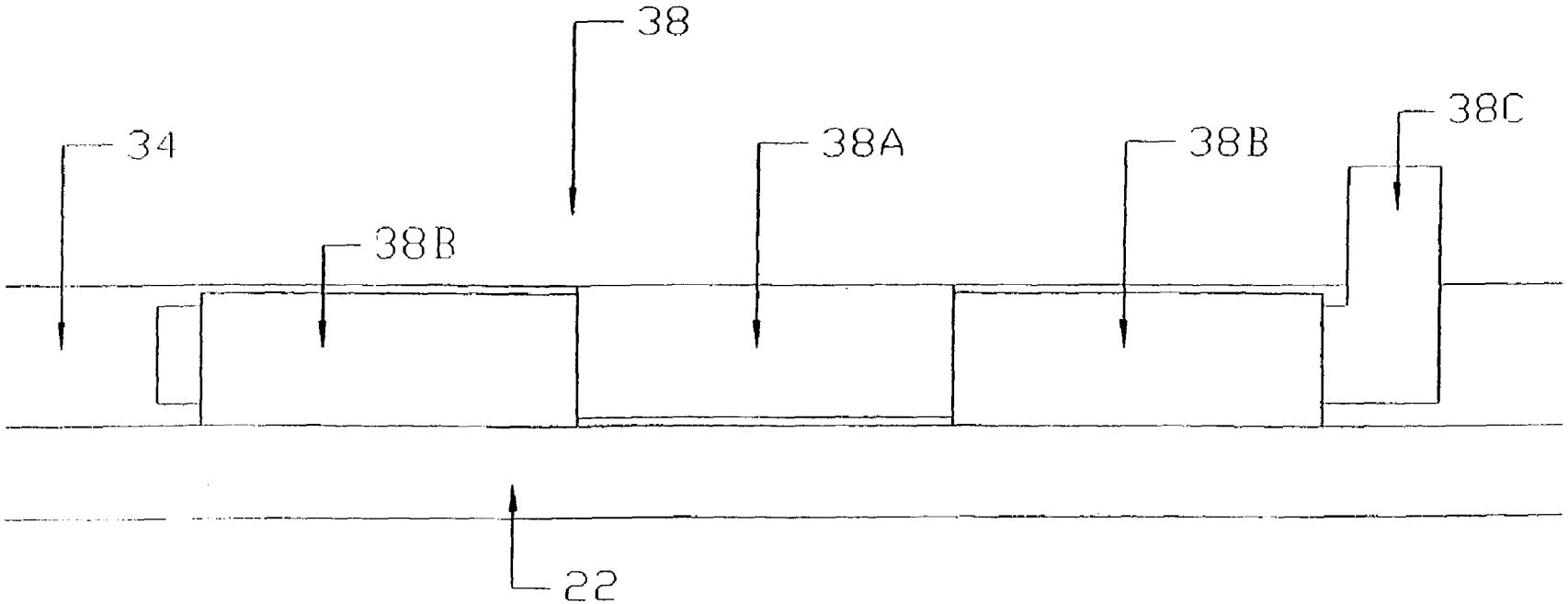
FIG. 11 is a top view of a Trough Hinge Assembly.

The trough hinge assemblies (38) are employed to roll pipe joints out of the pipe trough as shown in FIGS. 6 and 7. The trough hinge assemblies (38) secure the trough saddles (34) to the trough (22) by means of a removable trough pin (38C) inserted through the saddle links (38A) mounted to the edges of the trough saddles (34) and the corresponding trough links (38B) mounted at the edge of trough (22) as shown in FIG. 11. The hinge assemblies (38) are utilized on both ends of the trough saddles (34) at the sides of the trough (22).

Selective removal and/or placement of the hinge pins (38C) from the end of a trough saddle (34), at a desired side of the trough (22), will allow the pipe support trough (22) to pivot to the opposite side of the trough (22) by the extension of the ram (36A) of the trough lift (36) as it pivots on the trough bearing (22A). Continued extension of the ram (36A) will tilt the trough (22) over on the desired side of the pipe lifting structure (20). In this manner pipe lifted in the trough (22) can be rolled from the trough (22) to a floor surface or on to the pipe guide (50) as may be required by a user.

The lifting operation of the apparatus (10) is shown in FIGS. 1 through 5. It is contemplated that the entire apparatus (10) be operated by a system of hydraulic cylinders and rams and that these cylinders and rams will be remotely controlled from a control system positioned at a point away from the unit.

Figure 2:
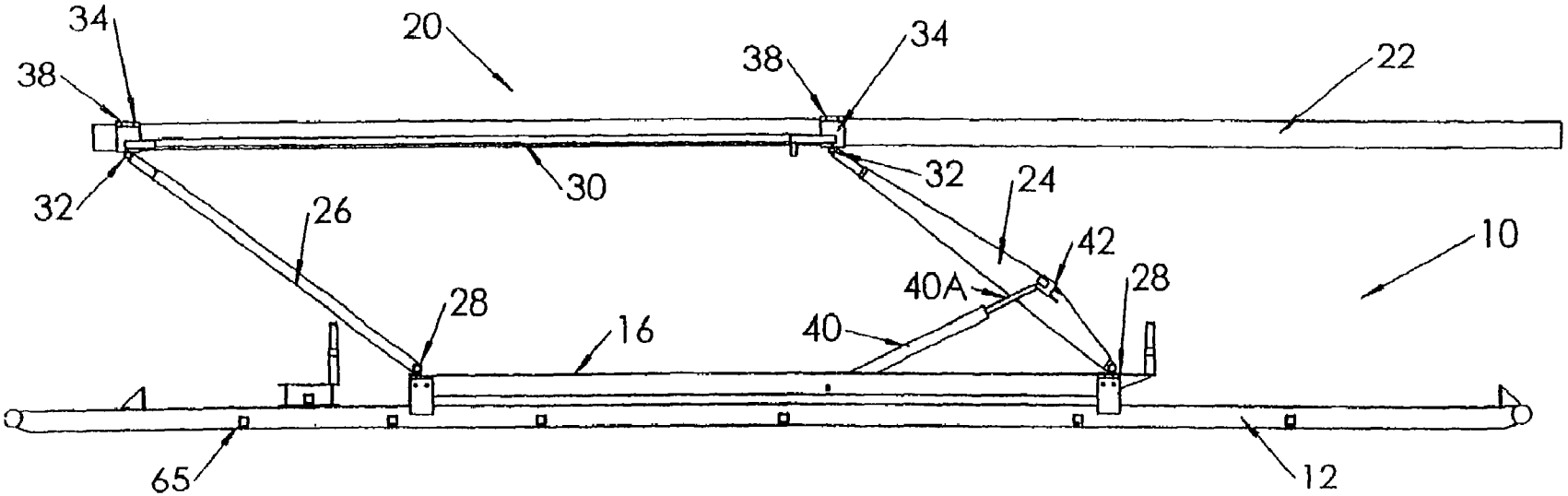
FIG. 2 is a side view of the Applicant's claimed invention with the lifting trough in an elevated position at the first stages of a lift.
Figure 3:
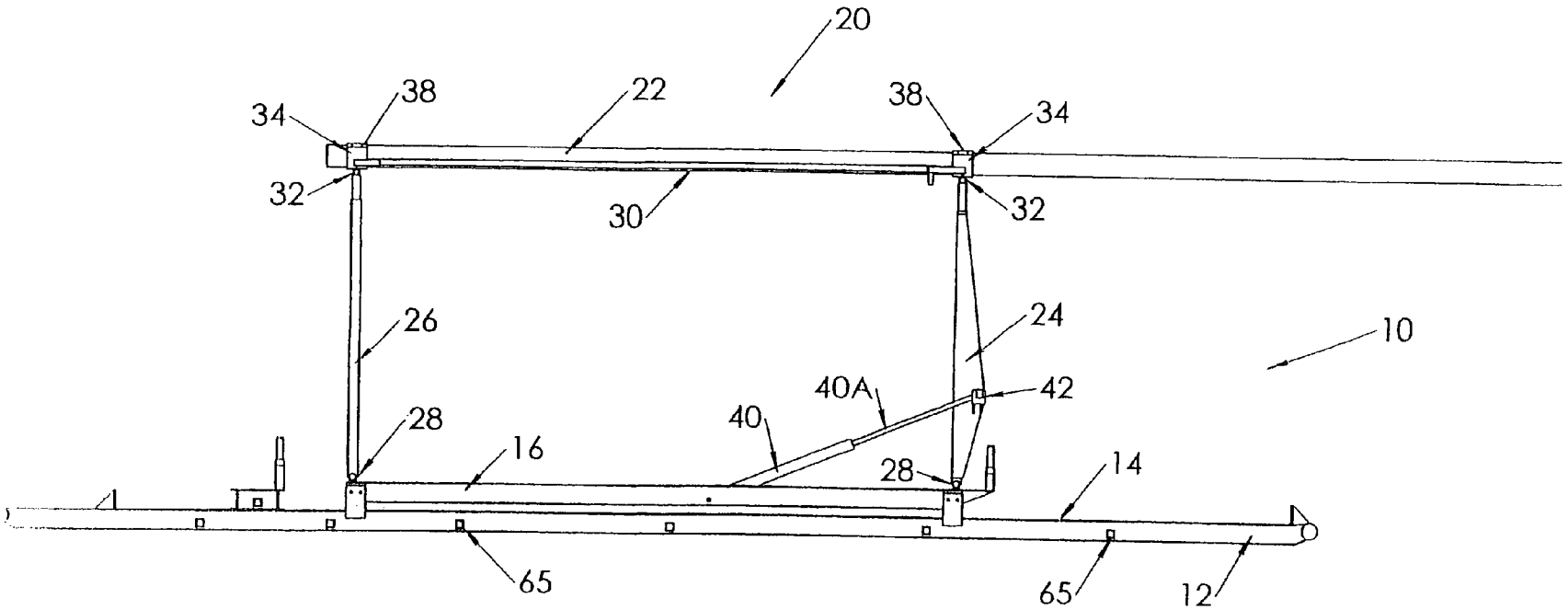
FIG. 3 is a side view of the Applicant's invention with the first and second lifting arm assemblies in a fully lifted position.

In FIG. 1, the apparatus (10) is positioned in a nested position with the lifting structure assembly (20) in its lowest position on the movable carriage (16). As shown in FIGS. 2 and 3, extension of the rams (40A) will tilted up and lift the first telescoping lifting arm assembly (24) as it pivots on its bearing (28) and as a result the movable trough (22) will be lifted. Simultaneously, the second lifting arm assembly (26) will be pulled upward by the connected lifting structure stabilizer frame (30) causing the other end of the trough (22) to elevate. The lifting structure stabilizer frame (30) supports and stabilizes the movable trough (22) during operation.

Figure 4:
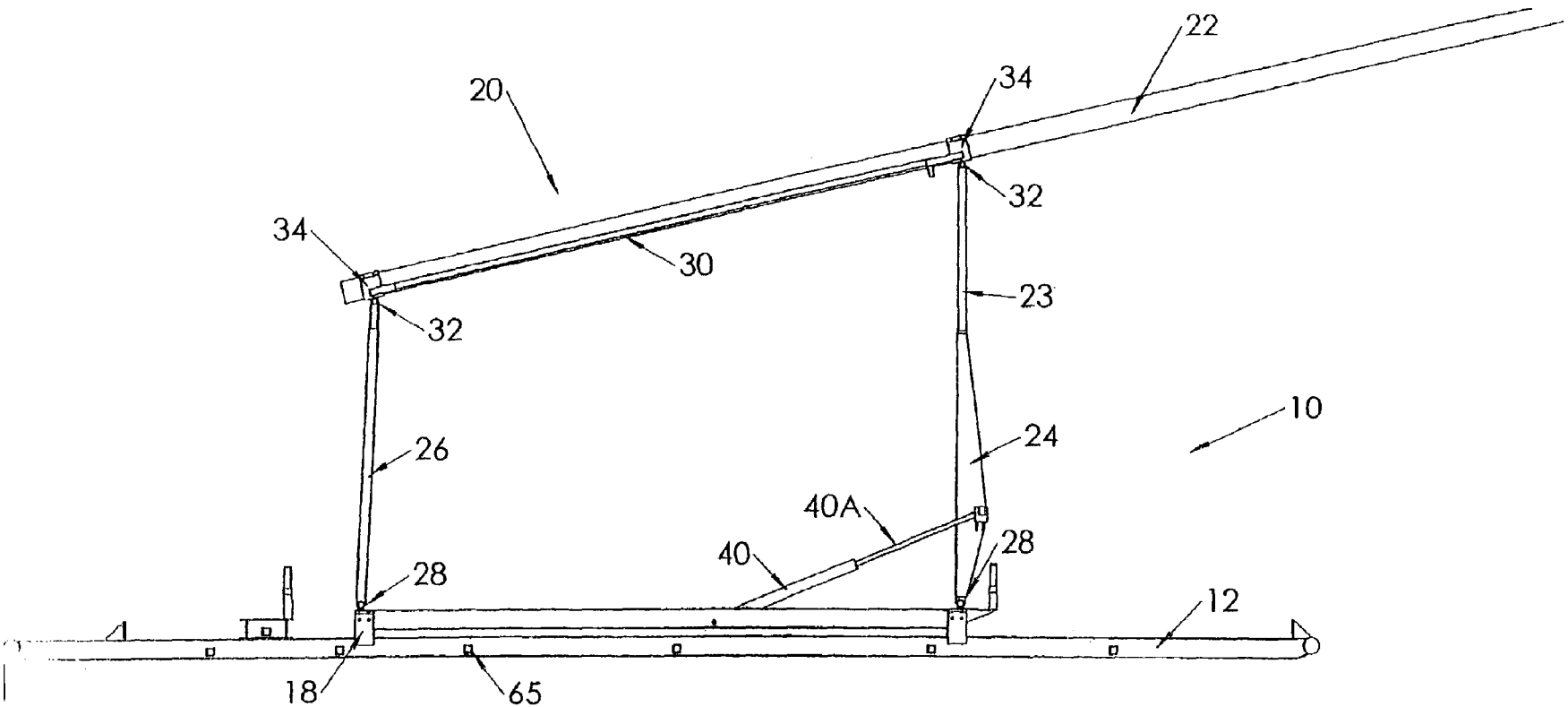
FIG. 4 is a side view of Applicant's claimed invention with the first lifting arm assembly in a lifted and extended position.
Figure 5:
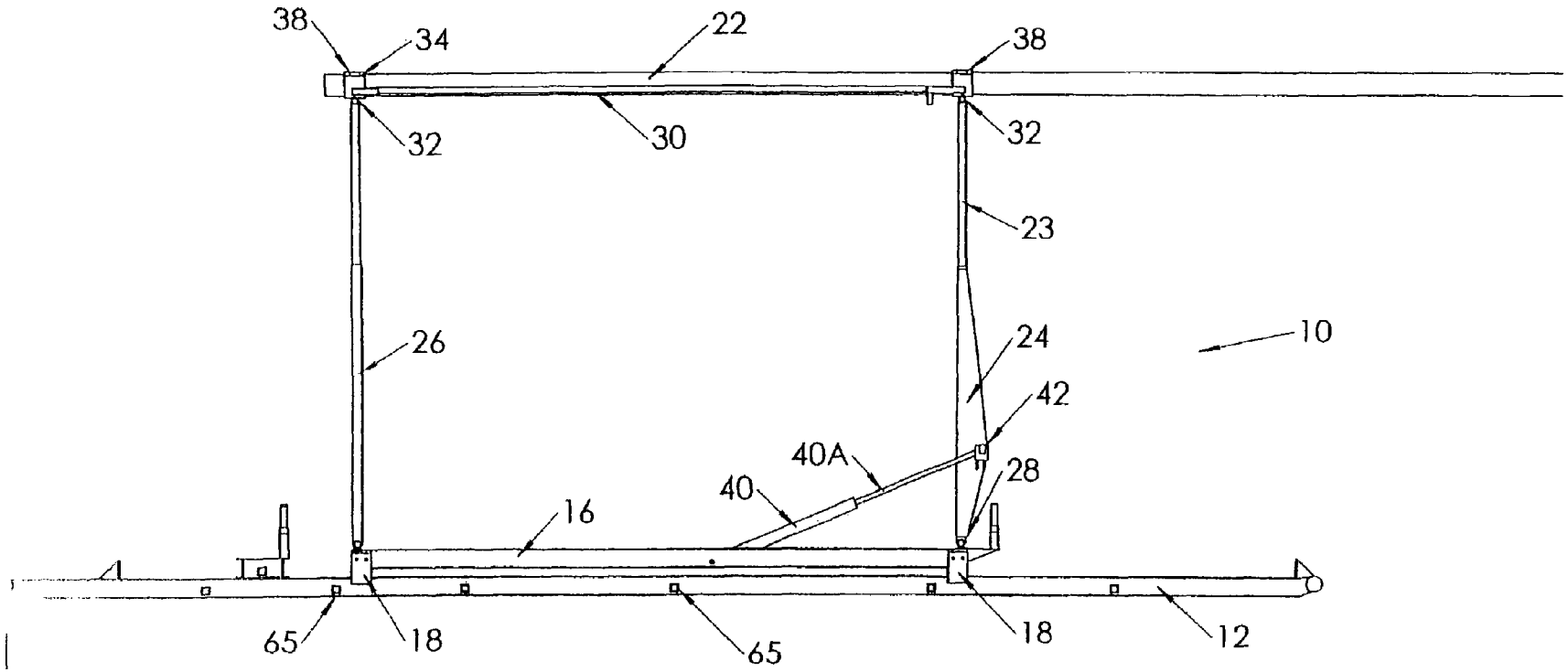
FIG. 5 is a side view of Applicant's claimed invention with the first and second lifting arm assemblies lifted and extended.

As shown in FIG. 4, further elevation of the trough (22) may be made by extension of the first lifting arm assembly (24) as described above. Extension of the second lifting arm assembly (26) will result in lifting the trough (22) to a level position as shown in FIG. 5. In this manner the lift is accomplished to the full extension of the lifting arm assemblies (24, 26). Lifts to intermediate positions are accomplished by tilting the lifting arm assemblies (24, 26) to a desired level by means of the rams (40A), and then extending or retracting the lifting arms (24, 26) as desired by means of lifting arm extension assembly (25).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe pickup and laydown apparatus comprising:

(a) a base frame, said base frame having a longitudinal axis and transverse axis extending perpendicular to said longitudinal axis;

(b) a carriage supported on said base frame said carriage having a longitudinal axis corresponding to said longitudinal axis of said base frame;

(c) a pipe lifting structure mounted to said carriage for independently supporting a length of pipe in longitudinal position with respect to said longitudinal axis of said base frame, said pipe lifting structure having first and second lifting arm assemblies, each of said lifting arms having first and second ends, said first ends of each of said lifting arm assemblies being pivotally mounted to said carriage, said pipe lifting structure further comprised of a concavely configured longitudinally extending pipe support trough and a lifting structure stabilizer frame pivotally attached to said each second end of said first and second lifting arm assemblies and positioned to extend longitudinally with respect to said longitudinal axis of said base frame between said first and second lifting arm assemblies, said lifting structure stabilizer frame being configured to support said pipe support trough and a length of pipe supported thereon, said pipe support trough and said stabilizer frame each having a longitudinal axis corresponding to said longitudinal axis of said base frame and a transverse axis perpendicular to its said longitudinal axis; and (d) a hydraulic ram pivotally attached to said carriage and said first lifting arm assembly whereby said lifting arm assemblies may be pivotally lifted from between a longitudinal position along said carriage and a vertical position perpendicular to said carriage and thereby raising and lowering said length of pipe;

(e) wherein at least one of said first and second lifting arm assemblies has lower tubular lifting arm columns extending from said first ends of said lifting arm assemblies and corresponding upper lifting arm columns extending from said second ends of said lifting arm assemblies toward said first ends of said lifting arm assemblies, said lower tubular columns configured to receive said corresponding upper lifting arm columns, whereby said upper lifting arm columns may be telescopically retracted into said lower tubular lifting arm columns and telescopically extended from said lower tubular lifting arm columns;

(f) means for selectively moving said carriage from one position to another along said longitudinal axis of said longitudinally extending base frame, (g) at least one extendable and retractable hydraulic ram, said ram having one end attached to said upper lifting arm columns and one end attached to said lower tubular lifting arm columns of a said lifting arm assembly whereby extension and retraction of said ram will telescopically retract said upper lifting arm columns into said lower tubular lifting arm columns and telescopically extend said upper lifting arm columns from said lower tubular lifting arm columns;

(h) a plurality of concavely configured saddles, said saddles having first and second ends, said saddles being positioned along said stabilizer frame whereby said pipe trough is supported on said saddles between said first and second ends of said saddles, with said saddles extending transverse to the longitudinal axis of said pipe support trough and said stabilizer frame for transversely supporting said pipe support trough with respect to its longitudinal axis;

(i) a hinge assembly mounted at each first and second end of said saddles, said hinge assembly having links and pin guides;

(j) a hinge assembly mounted on said pipe support trough, said hinge assembly having links and pin guides to corresponded with said hinge assembly on each of said saddles;

(k) a plurality of hinge pins, said hinge pins being selectively insertable and removable from desired said pin guides on first or second end of said corresponding hinge assemblies;

(l) means for pivoting said trough on said saddles transversely with respect to said base frame on said desired selectively insertable hinge pins to remove said length of pipe from said pipe trough; and (m) wherein said means for pivoting said trough transversely with respect to said base frame includes an extendable and retractable hydraulic ram, said ram having first and second ends, said first end of said ram mounted on said stabilizer frame below and between said trough and said second end of said ram pivotally mounted to said trough whereby extension and retraction of said ram will pivot said trough in a desired and selected direction transversely with respect to said base frame on said desired selectively insertable hinge pins to remove said length of pipe from said pipe trough.

2. The apparatus as recited in claim 1, further comprising:

(a) a pipe lifting jack for holding said pipe segment, said jack comprising a male support strut adapted to fit into any one of a plurality of female support strut sockets positioned on said base frame, said support strut being pivotally mounted on an extendable and retractable hydraulic ram whereby said pipe segment is rolled onto and off of said pipe trough from said pipe lifting jack by the extension and retraction of said hydraulic ram; and (b) a removable pipe guide comprised of a lower frame having socket columns mounted on said carriage and a corresponding removable upper frame having legs that removably fit into said corresponding socket columns, said upper frame being configured to support a diagonally orientated guide bar on said frame legs so as to provide a sloped guide surface whereby said sloped pipe guide surface may be reversibly and selectively oriented as desired by removing said upper frame legs from said socket columns, reversing the orientation of said upper frame of said sloped pipe guide surface, and reinserting said upper frame legs into the socket columns.

3. A pipe pickup and laydown apparatus comprising:

(a) a base frame, said frame having a longitudinal axis and a transverse axis;

(b) a moveable carriage supported on said base frame;

(c) first and second lifting arm assemblies longitudinally spaced apart from each other along said carriage, each of said lifting arm assemblies being comprised of lower tubular lifting arm columns configured to receive corresponding upper lifting arm columns, said lifting arm assemblies having a first end at said lower tubular lifting arm columns, said first end being pivotally mounted to said carriage, and a second end at said upper lifting arm columns, said first and second lifting arm assemblies being pivotally positionable from a parallel position with respect to said base frame to a perpendicular position with respect to said longitudinal axis of base frame while said first and second lifting arm assemblies remain parallel with respect to one another;

(d) a pipe trough, said pipe trough extending longitudinally with respect to said longitudinal axis of said base frame, said pipe trough pivotally mounted to and extending between said second ends of said first and second lifting arm assemblies;

(e) an extendable and retractable ram, said ram having one end pivotally mounted to said carriage and its other end pivotally mounted to said first lifting arm assembly whereby both said first and said second lifting arm assemblies may be pivotally lifted and lowered by extension and retraction of said ram between a substantially parallel position with respect to said longitudinal axis of base frame to a substantially vertical, perpendicular position with respect to said longitudinal axis of base frame;

(f) an extendable and retractable hydraulic ram for telescopically extending said second end of one of said lifting arm assemblies distally away from its first end without extending said second end of said other lifting arm assembly, said ram having one end attached to said upper lifting arm columns and one end attached to said lower tubular lifting arm columns whereby extension and retraction of said ram will telescopically retract said upper lifting arm columns into said lower tubular lifting arm columns and telescopically extend said upper lifting arm columns from said lower tubular lifting arm columns;

(g) means for propelling said carriage longitudinally along said longitudinal axis of said base frame;

(h) means for selectively pivoting said pipe trough along either side of its longitudinal axis, wherein said means for selectively pivoting said pipe trough along either side of its longitudinal axis includes;

(i) a pipe trough support frame, said support frame having a longitudinal axis that extends longitudinally with respect to the longitudinal axis of said base frame;

(i) at least one concavely configured saddle, said saddle having first and second ends, said saddle being positioned along said stabilizer frame whereby said pipe trough is supported on said saddle between said first and second ends of said saddle, with said saddle extending transverse to the longitudinal axis of said pipe support trough and said stabilizer frame for transversely supporting said pipe support trough with respect to its longitudinal axis;

(k) a hinge assembly mounted at each first and second end of said saddle, said hinge assembly having links with pin guides;

(l) a hinge assembly mounted on said pipe support trough, said hinge assembly having links with pin guides to corresponded with said hinge assembly on each of said saddles;

(m) a plurality of hinge pins, said hinge pins being selectively insertable and removable from desired said pin guides on first or second end of said corresponding hinge assemblies on said saddle and said support trough; and (n) an extendable and retractable ram, extending between said pipe trough support frame and said pipe trough, said ram having one end pivotally mounted to said pipe trough.

4. A pipe pickup and laydown apparatus comprising:

(a) a horizontally and longitudinally orientated base frame;

(b) a moveable carriage supported on said base frame;

(c) first and second lifting arm assemblies longitudinally spaced apart from each other along said carriage, each of said lifting arms having first and second ends, said first ends of said lifting arm assemblies being pivotally mounted to said carriage, said first and second lifting arm assemblies being pivotally positionable from a substantially parallel position with respect to said base frame to a substantially perpendicular position with respect to said base frame;

(d) a longitudinally oriented pipe trough pivotally mounted to and extending between said second ends of said first and second lifting arm assemblies;

(e) an extendable and retractable ram, said ram having one end pivotally mounted to said carriage and its other end pivotally mounted to said first lifting arm assembly whereby both said first and said second lifting arm assemblies may be pivotally lifted and lowered by extension and retraction of said ram between a substantially parallel position with respect to said base frame to a substantially perpendicular position with respect to said base frame;

(f) means for independently telescopically extending said second end of one of said lifting arm assemblies distally away from its first end without extending said second end of said other lifting arm assembly;

(g) means for propelling said carriage longitudinally along said base frame;

(h) means for selectively pivoting said pipe trough along either side of its longitudinal axis, said means including a pipe trough support frame, at least one saddle mounted along said pipe trough support frame, said saddle extending to each transverse edge of said pipe trough, a hinge assembly mounted at each transverse end of said saddle, said hinge assembly adapted to receive a removable hinge pin, a hinge assembly mounted on said pipe trough to corresponded with said hinge assemblies of said saddle, said hinge assembly adapted to receive a removable hinge pin, a removable hinge pin, said hinge pin being selectively insertable and removable from said corresponding hinge assemblies, and an extendable and retractable ram, extending between said pipe trough support frame and said pipe trough, said ram having one end pivotally mounted to said pipe trough;

(i) a plurality of female pipe jack sockets mounted longitudinally along said base frame;

(j) a removable pipe lifting jack, said jack having a strut to which is pivotally mounted an extendable and retractable hydraulic ram, said jack having a male support socket adapted to selectively mate with desired said female pipe jack sockets;

(k) a plurality of female pipe guide sockets mounted longitudinally along said base frame; and (l) a removable pipe guide having a sloped guide surface, said pipe guide having a male support socket adapted to selectively and reversibly mate with desired said female pipe guide sockets.

5. The apparatus as recited in claim 4 wherein said means for propelling said carriage longitudinally along said base frame includes:

(a) a plurality of rails mounted to said base frame;

(b) a plurality of roller assemblies mounted to said carriage, said roller assemblies rollably supported on said rails; and (c) at least one extendable and retractable hydraulic ram mounted between said carriage and said base frame whereby said carriage may be propelled along said base frame by extension and retraction of said ram.

6. The apparatus as recited in claim 5 wherein said means for telescopically extending said second end of one of said lifting arm assemblies distally away from its first end without extending said second end of said other lifting arm assembly includes at least one extendable and retractable hydraulic ram mounted between said second end and said first end of each of said first and said second lifting arm assemblies.

* * * * *

US007635249C1

(12) EX PARTE REEXAMINATION CERTIFICATE (10048th)

United States Patent
Guidroz

(10) Number: US 7,635,249 C1
(45) Certificate Issued: Feb. 20, 2014

(54) PIPE PICK-UP AND LAYDOWN APPARATUS

(75) Inventor: Perry J. Guidroz, Breaux Bridge, LA (US)

(73) Assignee: Oilfield Innovators Limited, L.L.C., Lafayette, LA (US)

Reexamination Request:
No. 90/012,807, Mar. 19, 2013

Reexamination Certificate for:

| | |
|---|---|
| Patent No.: | **7,635,249** |
| Issued: | **Dec. 22, 2009** |
| Appl. No.: | **11/089,706** |
| Filed: | **Mar. 24, 2005** |

Related U.S. Application Data

(60) Provisional application No. 60/602,970, filed on Aug. 18, 2004.

(51) Int. Cl.
*B65G 1/133* (2006.01)
*E21B 19/00* (2006.01)

(52) U.S. Cl.
USPC ..... 414/746.1; 414/22.52; 414/22.54; 414/22.61; 414/589

(58) Field of Classification Search
USPC ..... 187/211, 215; 254/124; 414/22.52, 414/22.54, 589
See application file for complete search history.

(56) References Cited

To view the complete listing of prior art documents cited during the proceeding for Reexamination Control Number 90/012,807, please refer to the USPTO's public Patent Application Information Retrieval (PAIR) system under the Display References tab.

*Primary Examiner* — Jimmy G. Foster

(57) ABSTRACT

A self-contained, freestanding, modular, portable pipe pickup and laydown apparatus. The apparatus includes a movable carriage and carriage rail supported on base frame. The base frame includes means for moving the carriage along the length of base frame. The apparatus also includes a pipe trough supported on first and second telescoping pipe trough lifting assemblies pivotally mounted on the carriage. The pipe trough is semicircular in configuration which serves to cradle and manipulate a joint of pipe. Jacks are used to lift and tilt upward the telescoping pipe trough lifting assembles to raise the pipe trough and any supported pipe. The pipe trough may be leveled and otherwise manipulated by extension and retraction of the trough lifting assemblies. A hydraulic lift and detachable hinges are used to pivot the pipe trough on its edges as desired. The invention also provides a movable pipe jack and reversible pipe guides to facilitate the loading and unloading of pipe to and from the pipe trough.

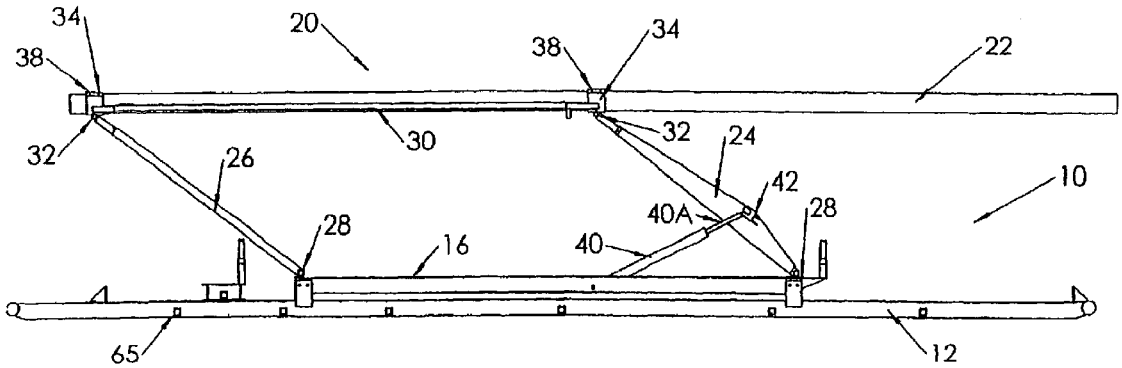

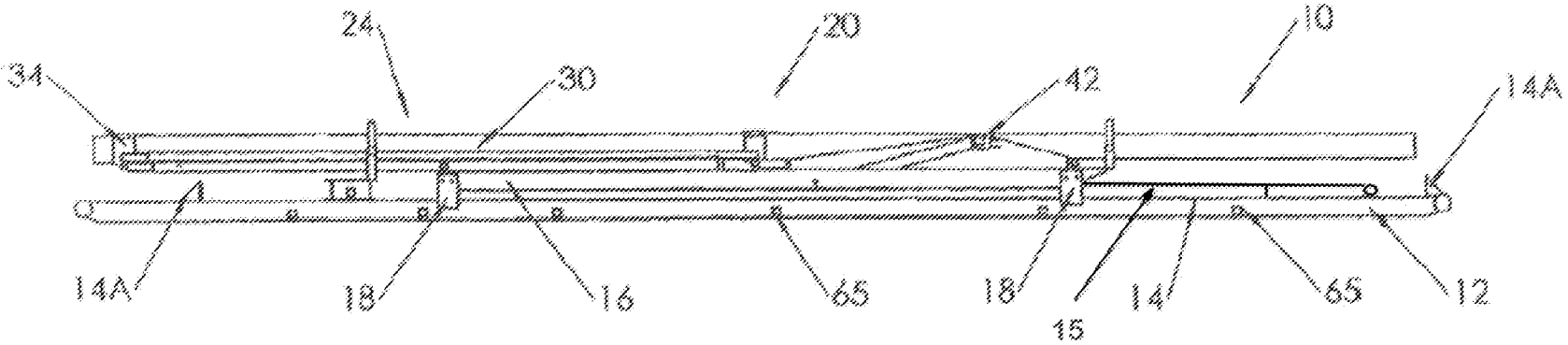
FIG: 1
Amended

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 34:

DRAWINGS-REFERENCE NUMERALS

| | | | |
|---|---|---|---|
| 10 | Apparatus | 12 | Base Frame |
| 14 | Base Support Rails | 14A | Rail Stops |
| *15* | *Carriage Propulsion Mechanism* | 16 | Carriage |
| 18 | Support Roller Assembly | 20 | Pipe Lifting Structure |
| 21 | Lower Lifting Ann Columns | 22 | Pipe Support Trough |
| 22A | Trough Lift Bearing | 23 | Upper Lifting Arm columns |
| 24 | Telescoping Lifting Arm Assembly | 25 | Lifting Arm Extension Assembly |
| 25A | Lifting Arm Extension Jack | 26 | Telescoping Lifting Arm Assembly |
| 28 | Lifting Arm Base Bearing | 30 | Stabilizer Frame |
| 32 | Stabilizer Frame Bearing | 34 | Trough Saddles |
| 36 | Trough Lift | 36A | Trough Lift Ram |
| 38 | Trough Hinge Assembly | 38A | Saddle Hinge Links |
| 38B | Trough Hinge Links | 38C | Removable Trough Hinge Pins |
| 40 | Lifting Arm Lift Assembly | 40A | Lifting Arm Lift Ram |
| 42 | Lifting Arm Lift Ram Bearing | 44 | Pipe Loading Mechanism |
| 46 | Pipe Lifting Jack | 48 | Reversible Pipe Guide |
| 52 | Lifting Jack Strut | 54 | Bearings |
| 56 | Extendable Jack | 58 | Extendable Jack Ram |
| 60 | Pipe Lift | 62 | Upper Pipe Lift Support Bracket |
| 63 | Male Support Strut | 64 | Pipe Lift Lower Leg |
| 65 | Support Strut Socket | 66 | Bracket Bearing |
| 68 | Bracket Bearing | 70 | Lower Pipe Guide Frame |
| 72 | Pipe Guide Socket Column | 74 | Upper Pipe Guide Frame |
| 76 | Upper Pipe Guide Frame Legs | 78 | Pipe Guide Bar |

Column 4, lines 5-10:

The carriage (16) may be moved along the system of support rails (14) by means of the roller assemblies (18) and a carriage propulsion mechanism [(not shown)] (*15*) to place the carriage (16) in a desired position along the base frame (12) to facilitate a desired lifting position or sequence, Rail stops (14A) maintain the carriage (16) on the rail system (14).

THE DRAWING FIGURES HAVE BEEN CHANGED AS FOLLOWS:

FIG. 1 adds reference numeral 15 and a thin box (representative of the Carriage Propulsion Mechanism) in the figure to which the reference numeral points.

AS A RESULT OF REEXAMINATION, IT HAS BEEN DETERMINED THAT:

The patentability of claims 1-6 is confirmed.

New claim 7 is added and determined to be patentable.

*7. A pipe pickup and laydown apparatus comprising:*

*(a) a base frame, said base frame having a longitudinal axis and transverse axis extending perpendicular to said longitudinal axis;*

*(b) a carriage supported on said base frame said carriage having a longitudinal axis corresponding to said longitudinal axis of said base frame;*

*(c) first and second lifting arm assemblies each with a first end and a second end, a lifting structure stabilizer frame pivotally attached to said each second end of said first and second lifting arm assemblies and positioned to extend longitudinally with respect to said longitudinal axis of said base frame between said first and second lifting arm assemblies, said lifting structure stabilizer frame being mounted to the carriage for independently supporting a length of pipe in longitudinal position with respect to the longitudinal axis of said base frame, wherein said lifting structure stabilizer frame is an element of the pipe lifting structure, said lifting structure stabilizer frame having a longitudinal axis corresponding to said longitudinal axis of said base frame and a transverse axis perpendicular to its said longitudinal axis, said first ends of each of said lifting arm assemblies being pivotally mounted to said carriage;*

*(d) a concavely configured longitudinally extending pipe support trough being an element of the pipe lifting structure, said pipe support trough is supported upon said lifting structure stabilizer frame which is configured to support said pipe support trough and a length of pipe thereon, said pipe support trough having a longitudinal axis corresponding to said longitudinal axis of said base frame and a transverse axis perpendicular to its said longitudinal axis;*

*(e) a hydraulic ram pivotally attached to said carriage and said first lifting arm assembly whereby said lifting arm assemblies may be pivotally lifted from between a longitudinal position along said carriage and a vertical position perpendicular to said carriage and thereby raising and lowering said length of pipe;*

*(f) wherein at least one of said first and second lifting arm assemblies has lower tubular lifting arm columns extending from said first ends of said lifting arm assemblies and corresponding upper lifting arm columns extending from said second ends of said lifting arm assemblies toward said first ends of said lifting arm assemblies, said lower tubular columns configured to receive said corresponding upper lifting arm columns, whereby said upper lifting arm columns may be telescopically retracted into said lower tubular lifting arm columns and telescopically extended from said lower tubular lifting arm columns;*

*(g) an extendable and retractable hydraulic ram for selectively moving said carriage from one position to another along said longitudinal axis of said longitudinally extending base frame;*

*(h) at least one extendable and retractable hydraulic ram, said ram having one end attached to said upper lifting arm columns and one end attached to said lower tubular lifting arm columns of a said lifting arm assembly whereby extension and retraction of said ram will telescopically retract said upper lifting arm columns into*

*said lower tubular lifting arm columns and telescopically extend said upper lifting arm columns from said lower tubular lifting arm columns;*

(*i*) *a plurality of concavely configured saddles extending transversely to the longitudinal axis of said pipe support trough and said stabilizer frame, wherein said saddles support said pipe support trough with respect to its longitudinal axis, said saddles having first and second ends, said saddles being positioned along said stabilizer frame whereby said pipe trough is supported on said saddles between said first and second ends of said saddles;*

(*j*) *saddle hinge assemblies having links with pin guides, said saddle hinge assemblies mounted at each first and second end of said saddles;*

(*k*) *trough hinge assemblies having links with pin guides, said trough assemblies mounted on said pipe support trough, said trough hinge links and pin guides corresponding with said saddle hinge links and pin guides on each of the saddles;*

(*l*) *a plurality of removable hinge pins, said hinge pins being selectively insertable and removable from said pin guides on said first or second ends of said saddle hinge assemblies and said trough hinge assemblies; and*

(*m*) *an extendable and retractable hydraulic ram having first and second ends for transversely pivoting said trough on said saddles with respect to said base frame, said first end of said ram being mounted to said stabilizer frame and said second end of said ram being pivotally mounted to said trough, whereby first end of said ram is mounted below said trough between said trough and said second end of said ram to extend between said trough and said stabilizer frame, and whereby extension and retraction of said ram will pivot said trough in a desired and selected direction transversely with respect to said base frame on said desired selectively insertable hinge pins of said saddle hinge links and said trough hinge links to remove said length of pipe from said pipe trough.*

* * * * *